US009095769B1

(12) United States Patent
Doung et al.

(10) Patent No.: US 9,095,769 B1
(45) Date of Patent: Aug. 4, 2015

(54) STABLE BOARD BOOK

(71) Applicant: Applied Underwriters, Inc., Omaha, NE (US)

(72) Inventors: Carrie Shaosha Doung, San Mateo, CA (US); Steven M. Menzies, Omaha, NE (US); Nathan Franklin Wells, Lafayette, CA (US)

(73) Assignee: Applied Underwriters, Inc., Omaha, NE (US)

( * ) Notice: Subject to any disclaimer, the term of this patent is extended or adjusted under 35 U.S.C. 154(b) by 0 days.

(21) Appl. No.: 14/513,258

(22) Filed: Oct. 14, 2014

(51) Int. Cl.
*A63F 3/00* (2006.01)

(52) U.S. Cl.
CPC ..... *A63F 3/0023* (2013.01); *A63F 2003/00246* (2013.01)

(58) Field of Classification Search
CPC ..... A63F 3/0023; A63F 2003/00246; A63F 9/12; A63H 33/38; B42D 1/007; B42D 1/00; B42D 1/08; A47B 23/042; A47B 23/044; B42F 13/402; B42F 5/005
USPC ..... 273/285, 287
See application file for complete search history.

(56) References Cited

U.S. PATENT DOCUMENTS

| | | | | |
|---|---|---|---|---|
| 1,810,951 | A | 6/1931 | Eisenberg | |
| 2,138,496 | A | 11/1938 | Light | |
| 3,189,369 | A * | 6/1965 | Walker | 281/33 |
| 3,353,844 | A | 11/1967 | Staats | |
| 3,809,404 | A | 5/1974 | Fikse | |
| D252,530 | S | 7/1979 | Budish | |
| 4,790,534 | A | 12/1988 | Jamison | |
| 5,533,757 | A * | 7/1996 | Morris | 281/15.1 |
| 6,132,216 | A | 10/2000 | Muntean et al. | |
| 6,364,360 | B1 * | 4/2002 | Kaufman | 281/15.1 |
| 7,159,864 | B1 | 1/2007 | Fleury | |
| 7,448,628 | B2 | 11/2008 | Pedersen | |
| 2004/0012190 | A1 | 1/2004 | D'Andrea | |
| 2006/0220310 | A1 | 10/2006 | Scarboro | |
| 2007/0024046 | A1 * | 2/2007 | Loo | 281/15.1 |
| 2007/0205553 | A1 | 9/2007 | Turley | |
| 2009/0206590 | A1 | 8/2009 | Gerth | |
| 2011/0316266 | A1 | 12/2011 | Miranti | |

OTHER PUBLICATIONS

Mike Vago, The Miniature Book of Miniature Golf, Jul. 3, 2014.
Youtube, Only a Game—The Minature Book of Minature Golf, Jun. 12, 2014.
Shoebox Media, 2014 Catalog, www.shoeboxmedia.net, Jul. 9, 2014.
Little Obsessed, Tabletop Miniature Golf Game, http://www.littleobsessed.com/tabletop-miniature-golf-game/, Jun. 12, 2014.
Workman Blog, The Making of the Minature Book of Miniature Golf, Jun. 12, 2014.

(Continued)

*Primary Examiner* — Vishu Mendiratta
(74) *Attorney, Agent, or Firm* — Mark Nowotarski

(57) ABSTRACT

A stable board book has multiple stiff pages bound together and a stand connected to an end panel for holding the pages vertical when the book is put on a surface and each page is opened. The stand is attached by a hinge to the top cover of the book and by a hinge to the end panel. The end panel is attached by a hinge to the ventral edge of the bottom page of the book. The length of the stand is at least ½ of the length of the cover so that when the pages are opened and leaned against the stand, they will be stable and not fall back down.

10 Claims, 4 Drawing Sheets

(56) References Cited

OTHER PUBLICATIONS

Dude!!! I Want That.Com, The Miniature Book of Miniature Golf, Jun. 12, 2014.

Dr. Carin Bondar, The Very Hungry Caterpillar Indeed . . . , http://carinbondar.com/2011/03/the-very-hungry-caterpillar-indeed/, Jun. 12, 2014.

* cited by examiner

STABLE BOARD BOOK

COPYRIGHT AND TRADEMARK NOTICE

A portion of the disclosure of this patent document contains material to which a claim for copyright is made. The copyright owner has no objection to the facsimile reproduction by anyone of the patent document or the patent disclosure, as it appears in the Patent and Trademark Office patent file or records, but reserves all other copyright rights whatsoever.

BACKGROUND OF THE INVENTION

Miniature golf is a popular game. A new type of miniature golf uses a board book to allow users to play miniature golf on a table top. As used herein, a "board book" is a book with stiff pages. A page is stiff if it can hold its own weight when held horizontally or vertically. FIG. 1 is a perspective view of a prior board book 100 called "The Miniature Book of Miniature Golf". The book comprises a plurality of stiff pages 102, binding for the pages 104, a stand 106 and an end panel 109. The stand and end panel are made from creased card stock about 1/64 inch thick. The stand is hingedly connected to the front cover 107 of the book and the end panel. The end panel is hingedly connected to the stand and the last page 111 of the book. When the book is closed, the stand rests against the front cover and the end panel rests against the book binding. When the book is open, the stand supports opened pages 108 in an upright orientation.

Each page represents a hole of golf. A portion of each page is recessed 115. The recess is a portion of the course. An opening 110 is provided in the recess that goes through the page to a corresponding course on the page below. The opening is seen as a "cup" in golf. In order to play a hole, a user 112 holds a small club 114 and hits a small ball 116 along the course. When the ball goes in the cup, the hole is complete and the ball passes through to the course below. The user then lifts up the page and rests it against the stand to reveal the page below. The ball that went through the cup is now on the course of the next hole on the page below. The user then continues to hit the ball until it goes in that page's cup. This process is repeated until the last page is reached. Score is based on how many hits a user needs to complete each hole.

One of the limitations of the prior art board book is that some pages are unstable in the opened position. The prior art board book has 10 pages including the cover. The cover is page 1. Each page is about 6 inches long (122), 6 inches wide (124) and 1/8 inch thick (126). 10 pages are joined together. The end panel is about 1.38 inches long (128). This is about the same as the combined thickness of the pages. The stand is about 1.5 inches long (132). Thus the ratio of stand length to page length is about 0.25. It has been found by experiment that for this ratio of stand length to page length, pages 7 and 8 are unstable in the open position. When pages 7 or 8 are opened and placed against the stand, they will spontaneously flip back 118 to the closed position and interfere with play. There is need, therefore, for a board book design where all of the pages are stable in the open configuration.

SUMMARY OF THE INVENTION

The summary of the invention is provided as a guide to understanding the invention. It does not necessarily describe the most generic embodiment of the invention or the broadest range of alternative embodiments.

FIG. 2 is a side view of a stable board book 200. The stable board book is similar in construction to the prior art board book except that the ratio of the length 234 of the stand 202 to the length 208 of a page is much greater. It has been found that when the ratio of stand length to page length is 0.7 or greater then all of the pages are stable 236 in the upright orientation. The stable board book, therefore, can be used to make a miniature golf game that does not suffer from pages flipping back down on the player.

DETAILED DESCRIPTION

The detailed description describes non-limiting exemplary embodiments. Any individual features may be combined with other features as required by different applications for at least the benefits described herein. As used herein, the term "about" means plus or minus 10% of a given value unless specifically indicated otherwise.

Figure 1:
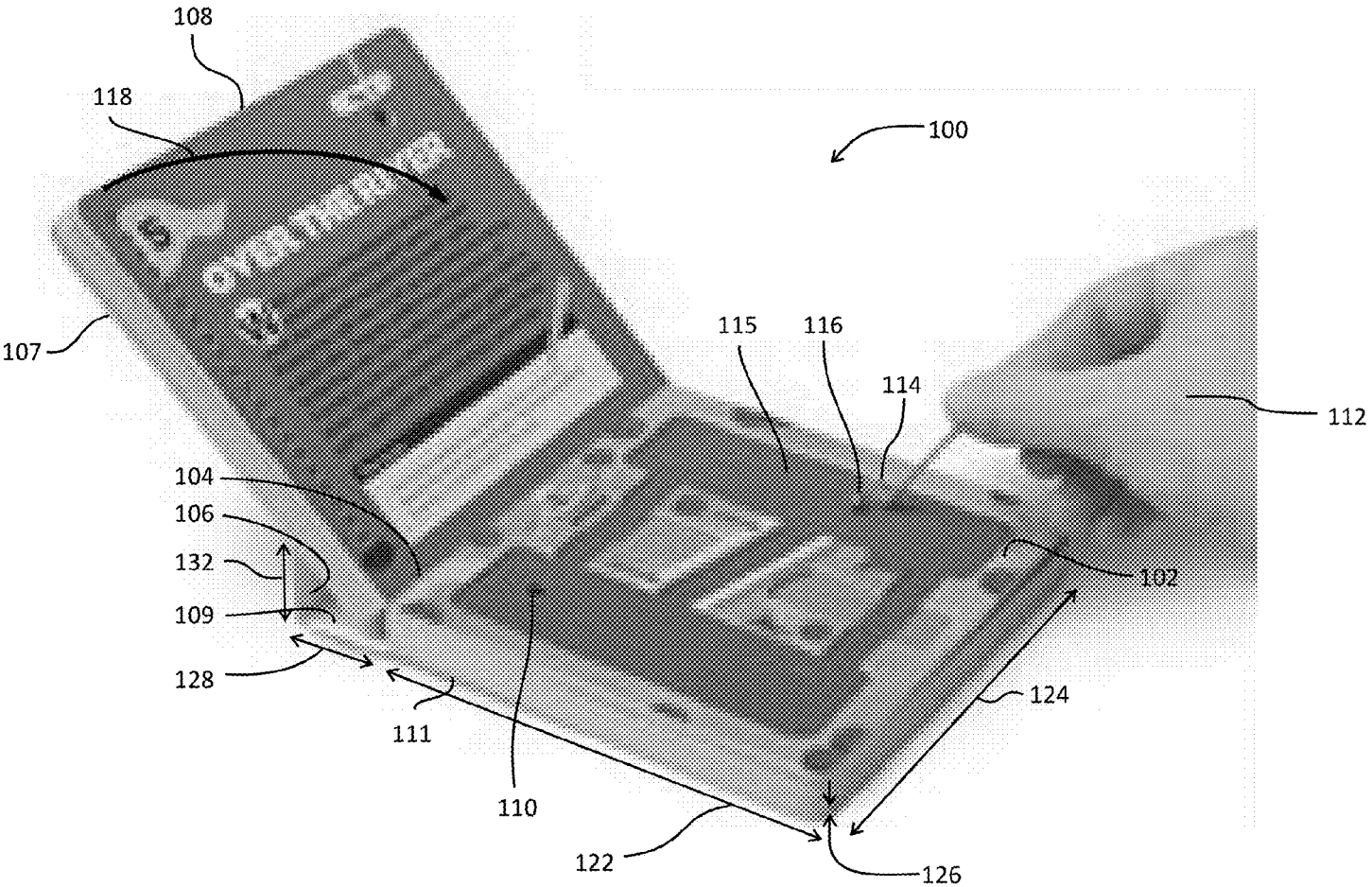
Fig. 1 (prior art)
FIG. 1 is a perspective view of a prior art board book.
Figure 2:
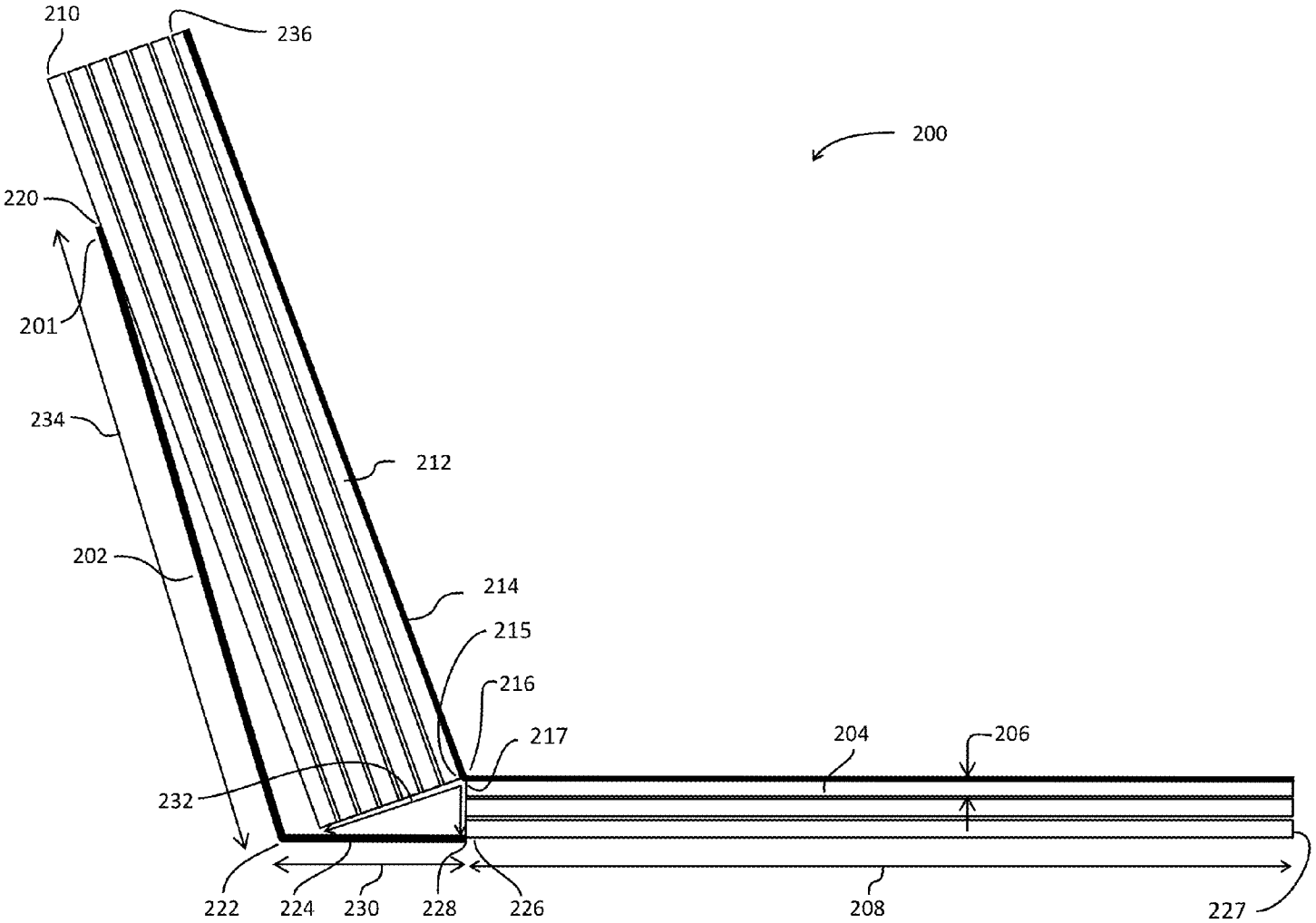
FIG. 2 is a side view of a stable board book.

Referring to FIG. 2, a stable board book comprises a plurality of pages 204. Each page has a thickness 206 and a length 208. A suitable thickness is about 1/8 inch. A suitable length is about 6 inches. The pages may be constructed of any stiff material, such as card stock, utility board or illustration board. Each page may be constructed by gluing, or otherwise attaching, two or more layers of board to get a desired thickness. A double layer of about 0.8 ounce illustration board is suitable. The pages can be any width. A suitable width is about 6 inches. There can be any number of pages. 10 pages is a suitable number of pages including the cover 210. Adjacent pages 204, 212 may be bound together along their adjacent ventral edges 215, 217 with a thin flexible film 214. The film is flexible enough to form a page hinge 216 when said film spans from one page to the next. The page hinges form the binding. Other bindings may be used. The film may be printable glossy paper stock with an image printed thereupon. Appendix A attached hereto provides exemplary images that may be printed on the pages of a stable board book.

The dorsal end 201 of the stand 202 may be attached to the cover 210 by a stand hinge 220. The stand hinge may comprise a flexible film. The ventral end of the stand may be attached to the dorsal end of an end panel 224 by a panel hinge 222. The ventral end of the end panel may be attached to the ventral end 226 of the last page 227 by a binding hinge 228.

The length 230 of the end panel should be equal to or greater than the combined thickness of the pages of the book 232. Thus the end panel will rest against the binding when the book is closed. The length of the stand 234 should be large enough so that all pages of the book are stable in the upright position 236 when opened. It has been found that a ratio of stand length to page length of 0.7 or greater produces a stable book.

Example 1

A 10 page stable board book was constructed according to FIG. 2. Each page was about 1/8 inch thick. The pages were about 6 inches long by 6 inches wide. Each page was constructed by gluing two pieces of 0.8 ounce board stock together. Paper glued to the boards was used for constructing all hinges. The end panel was about 1.25 inches long. Different book designs were evaluated with different stand lengths to determine page stability. The results are presented in table 1.

TABLE 1

| Ratio of stand length to page length | Unstable pages |
|---|---|
| 0.83 | none |
| 0.78 | none |
| 0.67 | 9 |
| 0.50 | 9 |
| 0.33 | 8,9 |
| .25 (prior art) | 7,8 |
| 0.17 | 7,8,9 |

Data for the prior art book is shown for comparison. It was found that longer stand lengths were more stable than shorter stand lengths. A ratio of stand length to 0.5 or greater was significantly more stable than the prior art. Ratios of 0.78 and 0.83 were stable for all pages. It is expected that a ratio of 0.7 will also be stable for all pages.

Combined Stand and Cover

Figure 3:
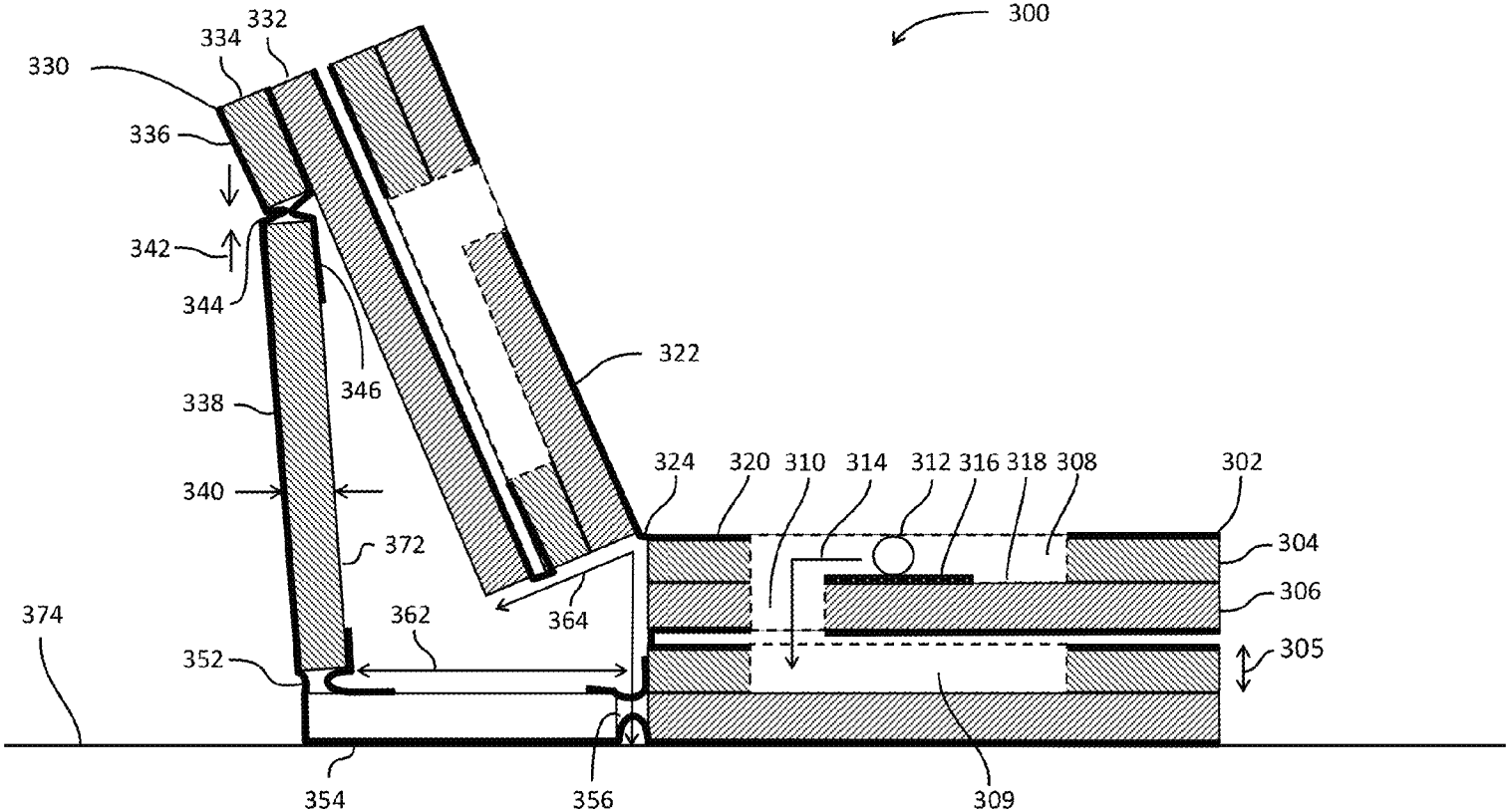
FIG. 3 is a side view of an alternative stable board book showing details of construction.

FIG. 3 shows a cross section of a stable board book with a combined cover and stand design 300. The book is shown with four pages 302. Each page comprises a top board 304 and a bottom board 306 glued together. Each board has a thickness 305 of about 1/16 inch. The top board may have a portion 308 removed to form a cavity when glued to the bottom board. This becomes the course for a golf game. A playing surface 316 may be provided. This corresponds to a green in golf. The playing surface may have a rough texture to correspond to grass. Hazard portions 318 of the course may be provided. The hazard portions are slightly recessed below the playing surface so that if the ball 312 falls in them, it's harder to hit out. If the ball is hit 314 to the cup opening 310 of the bottom board, it will fall through to the course of the page below 309. The player will lift the page and rest it against the stand and then play the next hole. A printable film 320 is provided on the top surface of each page and spans to the bottom surface 322 of the prior page. This forms a page hinge 324 between the adjacent pages.

The top cover 330 comprises a top board 334 and a bottom board 332. The top board comprises a first portion 336 and a stand 338. The first portion of the top board is joined to the bottom board. The stand is joined to the first portion by a stand hinge 344. A suitable hinge comprises a flexible hinge film 346 joining the stand to the first portion of the top board. Flexible film may be provided on both sides of the stand. A gap 342 may be provided between the first portion of the top board and the stand to allow the film to flex. A suitable gap is about 1/8 inch. The combined cover and stand design allows for a much thicker 340 and therefore stronger stand to be used than the prior art book. This is required for the larger stand lengths relative to the prior art.

The panel hinge 352 and the binding hinge 356 have similar construction to the stand hinge. It has been found that the stability of the book is improved if the internal length 362 of the end panel 354 is slightly larger than the combined internal thickness of the pages 364 so that there is a small gap between the stand and the bottom board of the cover when the book is closed. 1/16 is a suitable increase in length between the internal length of the end panel and the combined internal thickness of the pages. The internal lengths are defined as being measured from the inside surface of the stand 372 to the surface the book is sitting 374 when the book is closed.

Stable Page Construction

Figure 4A:
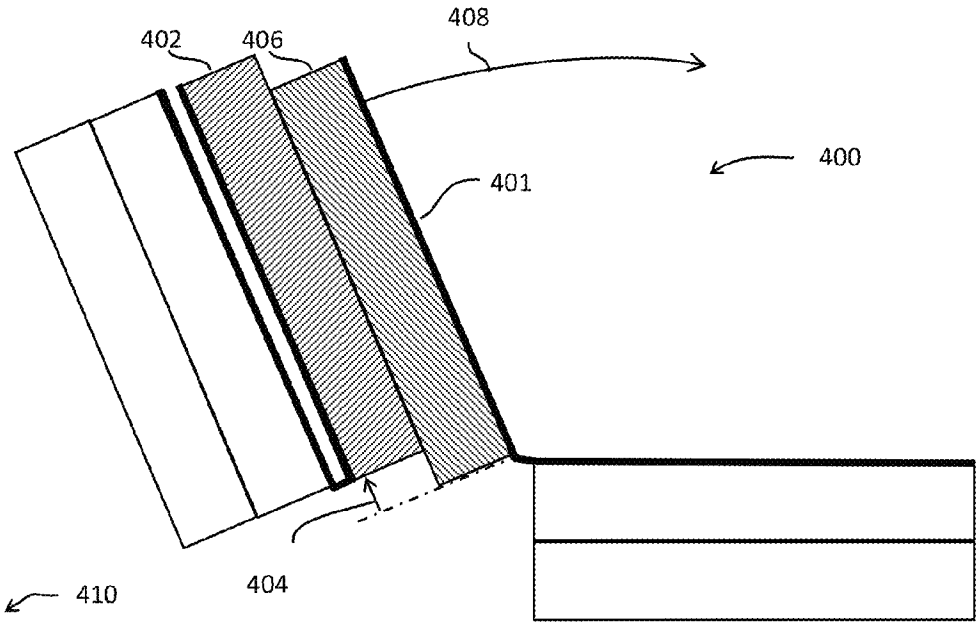
FIG. 4A is a side view of an alternative board book with unstable page construction.
Figure 4B:
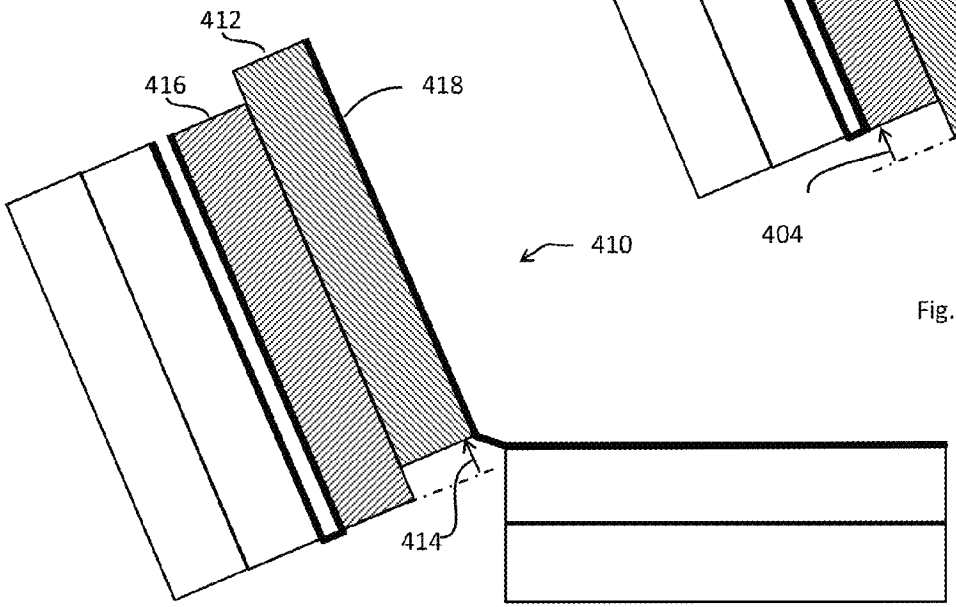
FIG. 4B is a side view of an alternative board book with stable page construction.

FIGS. 4A and 4B shows side views of details of alternative page constructions. 4A shows a relatively unstable page construction. 4B shows a relatively stable page construction. Referring to FIG. 4A, a detail 400 of page construction is shown. A page 401 comprises a top board 402 and a bottom board 406. The top board is indented 404 relative to the bottom board. It was found that for indents as small as 1/64 inch, the stability of the page was reduced and the page would flip back 408 after being opened.

Referring to FIG. 4B, a more stable page construction 410 is illustrated. In this configuration, the bottom board 412 of a page 418 is indented 414 relative to the top board 416. The indent 414 may be as small as 0 inches (i.e. the boards are even) or as large as 1/32 inch. Too large of an indent will not be pleasing aesthetically. The amount of designed indent can be based on the manufacturing tolerances. If the tolerances are +/−5 thousands of an inch, for example, then the designed indent can be 5 thousands so that all actual indents in the produced books will be in the range of about 0 to 10 thousands of an inch.

CONCLUSION

While the disclosure has been described with reference to one or more different exemplary embodiments, it will be understood by those skilled in the art that various changes may be made and equivalents may be substituted for elements thereof without departing from the scope of the disclosure. In addition, many modifications may be made to adapt to a particular situation without departing from the essential scope or teachings thereof. Therefore, it is intended that the disclosure not be limited to the particular embodiment disclosed as the best mode contemplated for carrying out this invention.

We claim:

1. A board book comprising:

a) a plurality of stiff pages wherein each of said pages comprises a top surface, a bottom surface, a ventral end adjacent to an end panel when said book is closed, a top ventral edge formed by the intersection of said top surface and said ventral end and a bottom ventral edge formed by the intersection of said bottom surface and said ventral end;

b) an end panel comprising a dorsal end located at the top of said end panel when said book is closed and a ventral end located at the bottom of said end panel when said book is closed; and c) a cover comprising:

i) a stand comprising a top surface, a bottom surface, a dorsal end and a ventral end opposite said dorsal end of the end plate;

ii) a first portion comprising a top surface, a bottom surface, a dorsal end and a ventral end opposite said dorsal end of the end plate; and iii) a bottom board comprising a top surface, a bottom surface, a dorsal end and a ventral end opposite said dorsal end of the end plate wherein:

d) said pages comprise said cover and a last page, said cover being at the top of said pages when said book is closed and said last page being at the bottom of said pages when said book is closed;

e) said pages are bound together by page hinges connecting said bottom ventral edges to said top ventral edges of adjacent pages;

f) said ventral end of said end panel is attached to said ventral end of said last page by a binding hinge;

g) said ventral end of said stand is attached to said dorsal end of said end panel by a panel hinge;

h) said dorsal end of said stand is attached to said ventral end of said first portion by a stand hinge;

i) said stand, said first portion and said bottom board of said cover have about the same thickness;

j) said bottom surface of said first portion is bound to said top surface of said bottom board such that said stand will lie about next to said bottom board and said top surface when said book is closed; and k) the ratio of the length between said ventral end of said stand and said dorsal end of said stand to the length between said ventral end of said bottom board and said dorsal end of said bottom board is 0.5 or greater.

2. The board book of claim 1 wherein said ratio is 0.7 or greater.

3. The board book of claim 1 wherein at least one of said pages comprises:

a) a top page board comprising a top surface, a bottom surface, a ventral end and a dorsal end; and b) a bottom page board comprising a top surface, a bottom surface, a ventral end and a dorsal end wherein:

c) said top surface of said bottom page board is bound to said bottom surface of said top page board such that said ventral and dorsal ends of said page boards are aligned except said ventral end of said-bottom page board is indented relative to said ventral end of said top page board.

4. The board book of claim 3 wherein said indentation is in the range of 0 to 1/32 of an inch.

5. The board book of claim 3 wherein a portion of said top board is removed and said bottom board has a hole aligned with said removed portion of said top board.

6. The board book of claim 1 wherein all of said pages have about the same thickness.

7. The board book of claim 1 wherein the length of said end panel between its ventral edge and its dorsal edge is greater than the combined thickness of said pages by about 1/16 inch such that there is a gap between said stand and said bottom board of said cover when said book is closed.

8. The board book of claim 1 wherein said stand hinge comprises:

a) a first flexible film; and b) a second flexible film wherein:

c) said first flexible film joins said top surface of said stand to said top surface of said first portion; and d) said second flexible film joins said bottom surface of said stand to said bottom surface of said first portion.

9. The board book of claim 8 wherein there is a gap between said dorsal edge of said stand and said ventral edge of said first portion.

10. The board book of claim 9 wherein said gap is about 1/8 inch.

* * * * *